US012215562B2

(12) United States Patent
Pirayeh Gar et al.

(10) Patent No.: US 12,215,562 B2
(45) Date of Patent: Feb. 4, 2025

(54) SEAL ELEMENT WITH PROFILED SURFACE FOR A DOWNHOLE TOOL IN A WELLBORE

(71) Applicant: Halliburton Energy Services, Inc., Houston, TX (US)

(72) Inventors: Shobeir Pirayeh Gar, Carrollton, TX (US); Xiaoguang Allan Zhong, Singapore (SG); Michael Linley Fripp, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/494,047

(22) Filed: Oct. 25, 2023

(65) Prior Publication Data

US 2024/0384620 A1 Nov. 21, 2024

Related U.S. Application Data

(60) Provisional application No. 63/502,692, filed on May 17, 2023.

(51) Int. Cl.
*E21B 33/12* (2006.01)

(52) U.S. Cl.
CPC ..... *E21B 33/1208* (2013.01); *E21B 33/1216* (2013.01)

(58) Field of Classification Search
CPC ..... E21B 33/1216; E21B 33/1208
See application file for complete search history.

(56) References Cited

U.S. PATENT DOCUMENTS

| | | | | |
|---|---|---|---|---|
| 2,912,292 | A * | 11/1959 | Lawitschka | F16J 9/20 277/444 |
| 3,473,814 | A * | 10/1969 | Bastow | F16J 15/166 277/584 |
| 3,921,988 | A * | 11/1975 | Prasse | F16J 9/28 277/944 |
| 3,940,155 | A * | 2/1976 | Baumle | F16J 15/3236 277/572 |
| 5,584,488 | A | 12/1996 | Lembcke | |
| 6,305,695 | B1 | 10/2001 | Wilson | |
| 6,565,093 | B2 | 5/2003 | Crow et al. | |
| 6,579,487 | B1 | 6/2003 | Lichtinger | |
| 9,835,252 | B2 * | 12/2017 | Kocurek | F16J 15/104 |
| 11,598,168 | B2 | 3/2023 | Pelto et al. | |
| 2005/0109502 | A1 | 5/2005 | Slay et al. | |
| 2018/0031129 | A1 | 2/2018 | Wallace | |
| 2021/0095541 | A1 | 4/2021 | Anderson et al. | |

OTHER PUBLICATIONS

"PCT Application No. PCT/US2023/077874, International Search Report and Written Opinion", Feb. 22, 2024, 10 pages.

* cited by examiner

*Primary Examiner* — D. Andrews
(74) *Attorney, Agent, or Firm* — DeLizio, Peacock, Lewin & Guerra LLP

(57) ABSTRACT

A seal element for providing a seal in a wellbore comprises a bonded seal with profiled surface that extends beyond a surface of a sleeve that includes the bonded seal with the profile surface, wherein the profiled surface of the bonded seal is to face a surface of a housing to form the seal, wherein the bonded seal with profiled surface has an asymmetric shape that comprises a back angle that is an acute angle.

20 Claims, 5 Drawing Sheets

SEAL ELEMENT WITH PROFILED SURFACE FOR A DOWNHOLE TOOL IN A WELLBORE

BACKGROUND

A seal element can be a component used to close a gap or make a joint fluid-tight with respect to both liquids and gases. Such sealing elements are frequently used in different applications downhole in a wellbore.

BRIEF DESCRIPTION OF THE DRAWINGS

Embodiments of the disclosure may be better understood by referencing the accompanying drawings.

DESCRIPTION

The description that follows includes example systems, methods, techniques, and program flows that embody aspects of the disclosure. However, it is understood that this disclosure may be practiced without these specific details. In some instances, well-known instruction instances, protocols, structures, and techniques have not been shown in detail in order not to obfuscate the description.

Example embodiments may include a seal element that may be used in different downhole operations within a wellbore at any of a number of different stages (e.g., drilling, completion, production, etc.). For example, some embodiments may include a seal element in different downhole tools. In some implementations, a seal element may be used in a multi-seal configuration (e.g., quad-seal configuration). For example, some embodiments may be used in a quad seal configuration for different sleeves (such as a multi-closing sleeve (MCS)).

Figure 1:
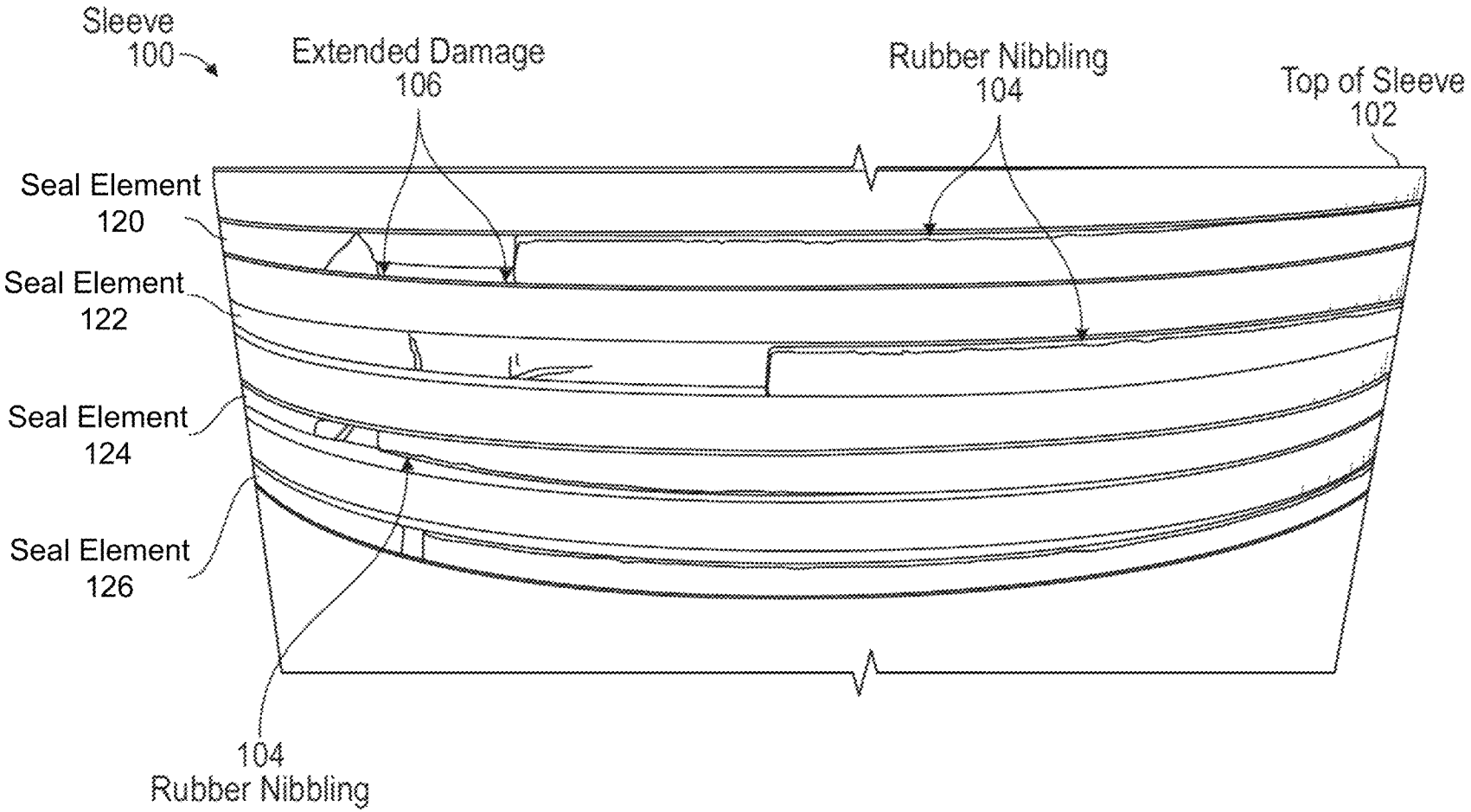
FIG. 1 is an elevated view on a side of a sleeve having a quad-seal configuration having rubber nibbling and extended damage.

For conventional sealing elements, predominate failure modes may be rubber nibbling and extended damage. FIG. 1 is an elevated view on a side of a sleeve having a quad-seal configuration having rubber nibbling and extended damage. As shown in FIG. 1, a sleeve 100 includes a top of the sleeve 102 and four seal elements (a seal element 120, a seal element 122, a seal element 124, and a seal element 126). Also shown in FIG. 1, the seal elements 120-126 have both rubber nibbling 104 and extended damage 106, which may be caused by extreme load and temperature cycles with repeated strokes during a downhole operation. Example implementations may include a more robust shape for the bonded seal with profiled surface of the seal element to eliminate or reduce failure modes such as rubber nibbling and extended damage (as described above).

As further described below, some implementations may include a seal element with a bonded seal with profiled surface. The asymmetric shape of the seal element (in accordance with example embodiments) may address the problem with bonded seal integrity when subjected to extreme load and temperature cycles with repeated strokes. In some implementations, a bonded seal may be defined as a structure that includes an elastomeric component that is fixedly attached (bonded) to a structure (such as a metallic structure). In general, the bonding may be accomplished through heat and pressure, such as through a vulcanization process. The bonding may be one or more sides of the elastomeric components. For example, the bonding may be on one, two, or three sides of the elastomeric component.

Example embodiments may profile the bonded seal cross sectional surface (the bonded seal with profiled surface) in an asymmetric manner where the front angle is chosen different than the back angle. In some implementations, the asymmetric shape of the bonded seal with profiled surface may be configured to have a back angle that is an acute angle. In some embodiments, the back angle may be between 8 and 28 degrees. In some embodiments, the seal front angle may include two angles (e.g., one zero-degree and one an acute angle (such as a 45-degree angle)). Additionally, the bonded seal with profiled surface may be positioned in a gland of a sleeve. The back angle may be extended to reach a bottom surface of the gland such that a void is formed within the gland.

Additionally, the bonded seal with profiled surface and void may be defined in terms of a void index. In some implementations, the void index may be defined as the void volume divided by the gland volume, wherein the gland volume may be a nonlinear function of the seal back angle (B) and the seal width (W). The gland volume may be defined as the volume of the gland cut at the outer surface of the sleeve before the bonded seal is molded therein. The void volume may be defined as the volume of the unfilled space below the outer surface of the sleeve. In some implementations, both of these volumes may be measured when the seal is an uncompressed state. The performance of the seal may be greatly affected by the void index. In some implementations, the void index may be between approximately 0.25 and 0.45. Accordingly, in contrast to conventional approaches, example embodiments may include using surface profiling of the bonded seal with the above-described features to enhance the mechanical robustness and integrity of the seal.

The term "approximately" as used herein is with reference to different properties (e.g., angles). In some implementations, the term "approximately" may be a variance of 10%. For example, for an angle, the variance may be +/−10% of the value.

Example Seal Element

Figure 2:
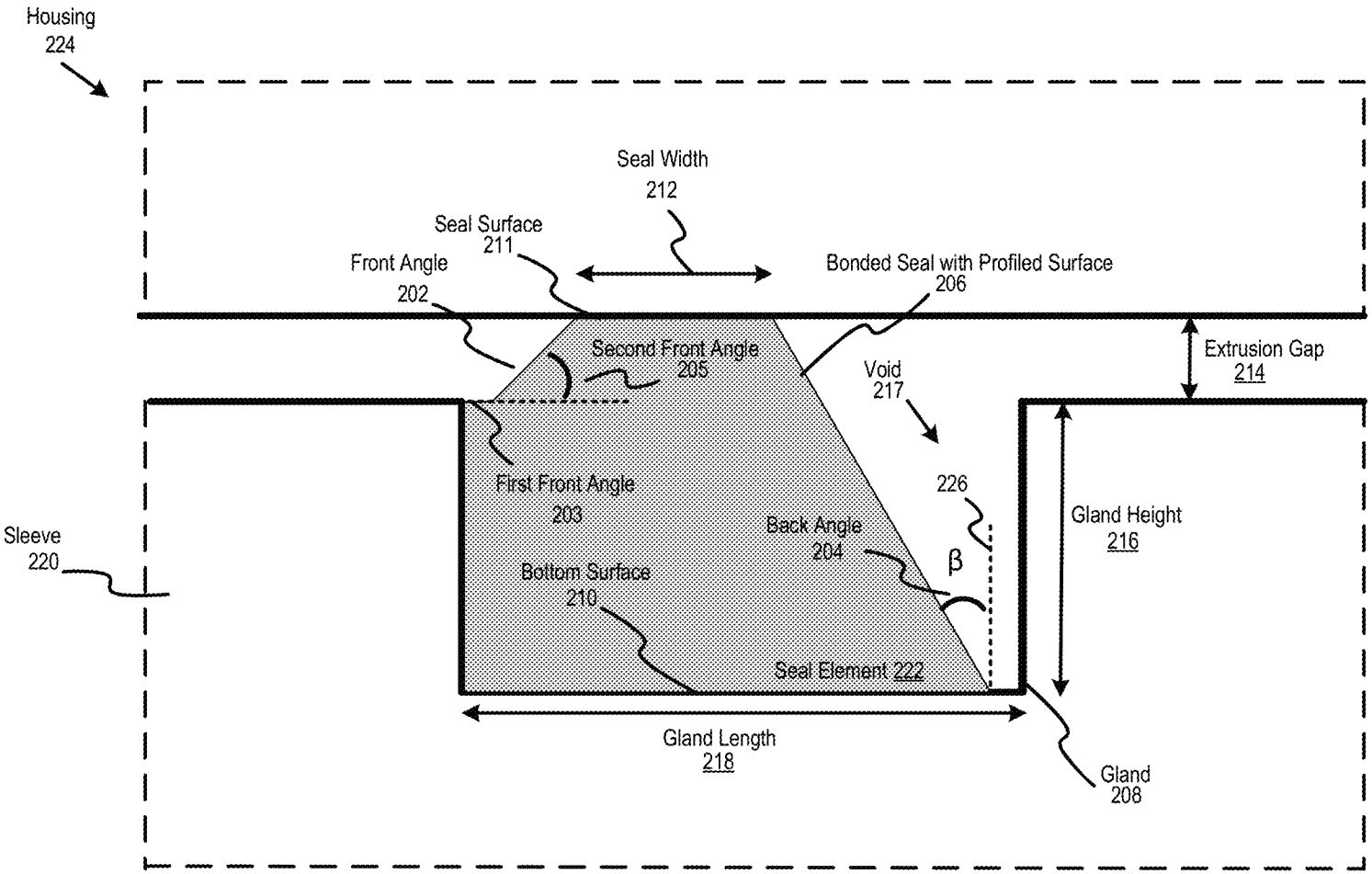
FIG. 2 is a side view of a seal element relative to a housing to which the seal element is to be sealed, according to some embodiments.

An example seal element is now described. FIG. 2 is a cross sectional view of a seal element relative to a housing to which the seal element is to be sealed, according to some embodiments. FIG. 2 includes a sleeve 220 and a housing 224. There is an extrusion gap 214 between the sleeve 220 and the housing 224. The sleeve 220 has a gland (cut out) 208. The gland 208 is located on a face of the sleeve 220 that is facing the inside surface of the housing 224. The gland 208 has a bottom surface 210 having a gland length 218. The gland 208 has a gland height 216.

A seal element 222 includes a bonded seal with profiled surface 206 that is molded into the gland 208. The bonded seal with profiled surface 206 has a seal surface 211 that has a seal width of 212. The seal surface 211 is the surface of the seal element 222 that is sealed to the surface of the inside surface of housing 224. As shown, the bonded seal with profiled surface 206 may have an asymmetric shape. For example, the bonded seal with profiled surface 206 may include a front angle 202 and a back angle 204 such that the front angle 202 is different from the back angle 204. In some implementations, the surfaces defining the front angle and back angle may be straight lines or approximately straight lines. In some implementations, the front angle 202 may include multiple angles. For example, the front angle 202 may include a first front angle 203 and a second front angle 205. For instance, the first front angle 203 may be approximately zero degrees and the second front angle 205 may be an acute angle. For example, the second front angle 205 may be approximately 45 degrees. In another example, the second front angle 205 may be between approximately 30 and 60 degrees.

Thus, the first front angle 203 may be a step that is added before the second front angle 205 to allow the bonded seal with profiled surface 206 to deform before the bonded seal with profiled surface 206 starts to extrude from the gland 208.

The back angle 204 may be extended to reach the bottom surface 210 of the gland 208 to form a void 217 within the gland 208 that is not filled by the bonded seal with profiled surface 206. In some embodiments, the back angle 204 may be an acute angle. For example, the back angle 204 may be between approximately 8 and 28 degrees. In some implementations, the void 217 may be filled with a seal backup material (e.g., a thermoplastic) 226 to support and control the back angle deformation and provide an energizing feature if needed.

In some implementations, the void index of the bonded seal with profiled surface 206 may be defined as the void volume divided by the gland volume. The gland volume may be a nonlinear function of the back angle 204 and the seal width 212. The performance of the seal may be greatly affected by the void index. In some implementations, the void index may be between approximately 0.25 and 0.45. Thus, in contrast to conventional approaches, example embodiments may include using surface profiling of the bonded seal with the features described herein to enhance the mechanical robustness and integrity of the seal and to reduce the risk of failure under extreme temperature and load cycles. Therefore, example embodiments may resolve these issues of rubber nibbling and extended damage without the need to change seal material, gland geometry, or manufacturing process.

Figure 3:
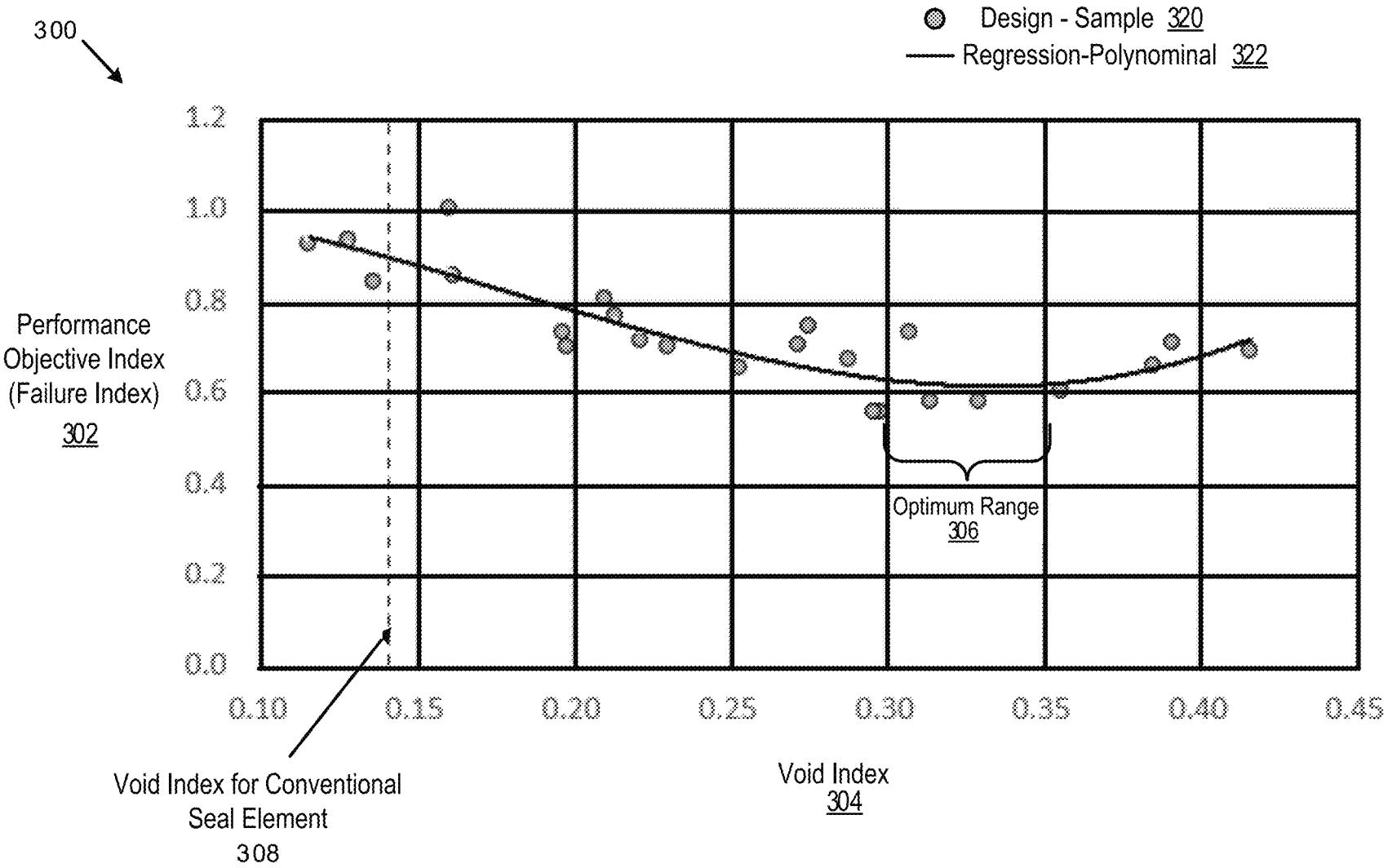
FIG. 3 is a graph that illustrates the relationship between the bonded seal failure index to the void index, according to some embodiments.

The seal integrity performance may be strongly correlated with the void index. To illustrate, FIG. 3 is a graph that illustrates the relationship between the bonded seal failure index to the void index, according to some embodiments. In FIG. 3, a graph 300 includes an X-axis 304 that is the void index and a Y-axis 302 that is the Performance Objective Index (POI) expressed in terms of a Failure Index.

The graph 300 includes design sample points 320 and a regression polynomial 322. Failure of a seal element may be indicated by a POI of close to one. The graph 300 includes a line 308 which is for a conventional seal element. As shown, the conventional seal element has a void index of approximately 0.147. This results in a POI of approximately 0.9 for the conventional seal element-which is near failure. The graph 300 also includes an optimum range 306 for the void index 304 that is approximately 0.30 to 0.35. In contrast to the conventional seal element, example embodiments of the seal element have a void index in the optimum range 306.

Therefore, because of its short comings, a conventional seal element could have a potential extrusion-having a rubber strain of approximately 120% (implying an impending damage and/or rubber nibbling). In contrast, example embodiments include a surface profiling of the bonded seal which substantially improves the cyclic performance and mechanical robustness of the seal. In such embodiments, there is no sign of a potential rubber extrusion. Additionally, the rubber strain is kept below 100%—with the highest being at approximately 86%.

Example Operations

Figure 4:
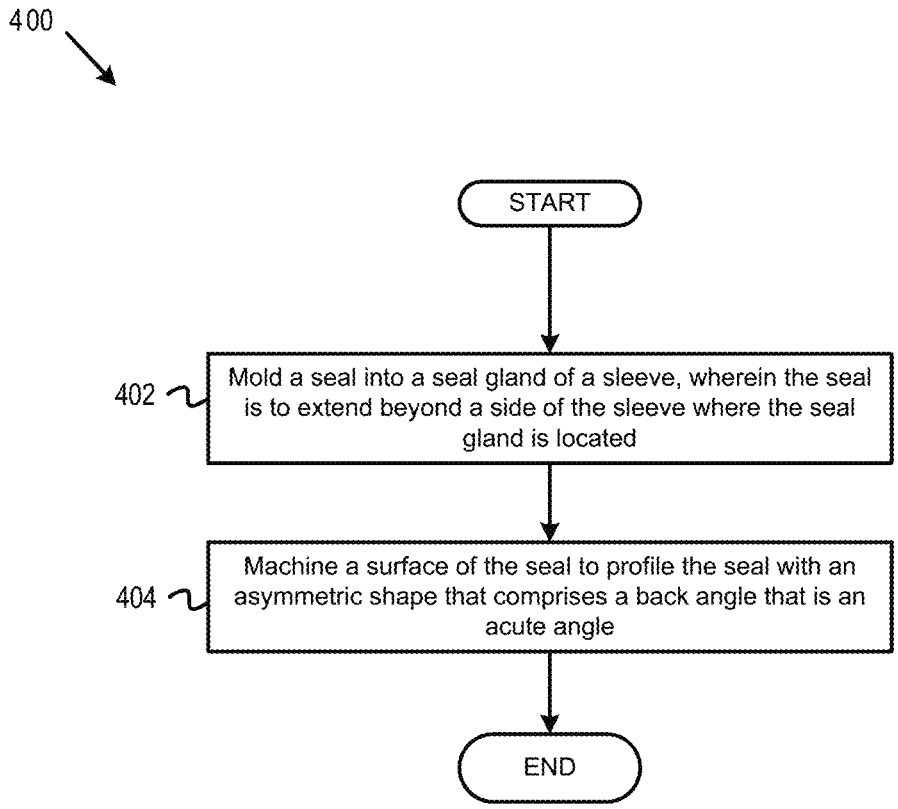
FIG. 4 is a flowchart of example operations for forming a seal element in a sleeve usable for operation in a wellbore, according to some embodiments.

FIG. 4 is a flowchart of example operations for forming a seal element in a sleeve usable for operation in a wellbore, according to some embodiments. Operations of a flowchart 400 can be performed by software, firmware, hardware, or a combination thereof. Operations of the flowchart 400 are described in reference to FIG. 2. The operations of the flowchart 400 start at block 402.

At block 402, a seal is molded into a seal gland, wherein the seal is to extend beyond a side of the sleeve where the seal gland is located. For example, with reference to FIG. 2, the bonded seal with profiled surface 206 may be positioned in the gland 208 prior to the front angle 202 and the back angle 204 being machined or formed therein.

At block 406, a surface of the seal is machined to profile the seal with an asymmetric shape that comprises a back angle that is an acute angle. For example, with reference to FIG. 2, the bonded seal with profiled surface 206 may be machined to include the front angle 202 and the back angle 204. The seal surface 211 of the seal element can then be bonded or sealed with a surface of the housing 224. Operations of the flowchart 400 are complete.

Example System

A seal element in accordance with example embodiments may be incorporated into any type of downhole configuration or system in a wellbore. For example, the seal element may be incorporated into any type of downhole tool (such as a completion tool). To illustrate, FIG. 5 is an elevation view in partial cross section of a well system having a seal element, according to some embodiments.

Figure 5:
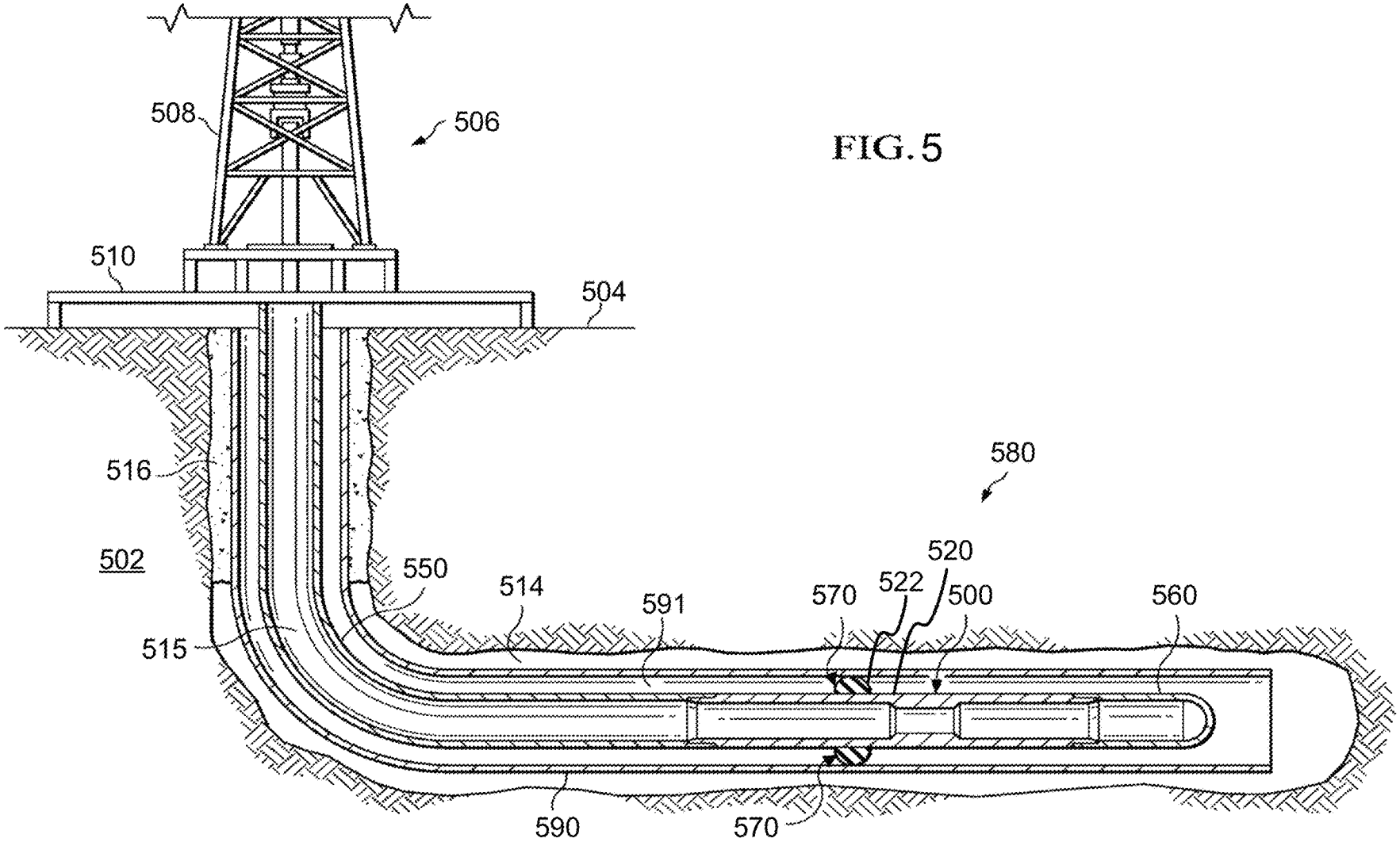
FIG. 5 is an elevation view in partial cross section of a well system having a seal element, according to some embodiments.

Referring to FIG. 5, the operating environment comprises a drilling or servicing rig 506 that is positioned on the earth's surface 504 and extends over and around a wellbore 514 that penetrates a subterranean formation 502 for the purpose of recovering hydrocarbons. The wellbore 514 may be drilled into the subterranean formation 502 by any suitable drilling technique. In an embodiment, the drilling or servicing rig 506 comprises a derrick 508 with a rig floor 510 through which a completion string 590 (e.g., a casing string) generally defining an axial flowbore 591 may be positioned within the wellbore 514. The drilling or servicing rig 506 may be conventional and may comprise a motor driven winch and other associated equipment for lowering a tubular, such as the completion string 590 into the wellbore 514, for example, so as to position the completion equipment at the desired depth.

The wellbore 514 may extend substantially vertically away from the earth's surface 504 over a vertical wellbore portion or may deviate at any angle from the earth's surface 504 over a deviated or horizontal wellbore portion. In some operating environments, portions or substantially all of the wellbore 514 may be vertical, deviated, horizontal, and/or curved.

In some implementations, a portion of the completion string 590 may be secured into position against the subterranean formation 502 in a conventional manner using cement 516. In alternative embodiment, the wellbore 514 may be partially completed (e.g., cased) and cemented thereby resulting in a portion of the wellbore 514 being uncemented. In an embodiment, a production string 550 comprising a tool 500 may be delivered to a predetermined depth within the wellbore. In some embodiments, the tool 500 may include a seal element (as described herein). For example, the tool 500 may include a seal element 522 in a sleeve 520. For instance, the seal element may be part of a quad seal configuration for a sleeve (such as a multi-closing sleeve (MCS)).

It is noted that although the tool 500 is disclosed as being incorporated within a production string in one or more embodiments, the specification should not be construed as so limiting. The tool 500 may similarly be incorporated within other suitable tubulars such as a casing string, a work string, liner, coiled tubing, a length of tubing, or the like.

Referring to FIG. 5, the production string 550 and/or the tool 500 may further comprise (e.g., have incorporated therein) one or more packers 570, for example, for the purpose of securing the production string 550 and/or the tool 500 within the wellbore 514, within the completion string 590, and/or isolating two or more production zones. The packer 570 may generally comprise a device or apparatus which is selectively configurable to seal or isolate two or more depths in a wellbore from each other by providing a barrier concentrically about a tubular string (e.g., the production string 550) and an outer surface (e.g., a wellbore or casing wall). In an embodiment, the packer 570 may comprise a hydraulic (or hydraulically set) packer. Alternatively, the packer may comprise any suitable configuration of mechanical packer or a swellable packer.

Additionally, in an embodiment, a portion of the interior of the production string 550 may be blocked with a plug 560, for example, so as to allow a pressure to be applied thereto. For example, in an embodiment of FIG. 5, the plug 560 may be positioned down-hole from the tool 500, thereby prohibiting and/or substantially restricting a fluid from moving via the axial flowbore of the production string 550, particularly, from moving out of the downhole, terminal end of the production string 550. Non-limiting examples of a plug suitably employed as plug 560 include a pump-through plug or a plug formed as an integral part of a production string.

While the operating environment depicted in FIG. 5 refers to a stationary drilling or servicing rig 506 for lowering and setting the production string 550 within a land-based wellbore 514, one of ordinary skill in the art will readily appreciate that mobile workover rigs, wellbore completion units (e.g., coiled tubing units).

Referring to FIG. 5, a wellbore completion system 580 is illustrated. In the embodiment of FIG. 5, the wellbore completion system 580 comprises the tool 500 incorporated with the production string 550 and positioned within a wellbore 514. Additionally, in an embodiment, the wellbore completion system 580 may further comprise the plug 560. In such an embodiment, the plug 560 may be incorporated with the production string 550, for example, as an integral part of the production string 550 and may be positioned relatively down-hole from the tool 500.

While the aspects of the disclosure are described with reference to various implementations and exploitations, it will be understood that these aspects are illustrative and that the scope of the claims is not limited to them. Many variations, modifications, additions, and improvements are possible.

Plural instances may be provided for components, operations or structures described herein as a single instance. Finally, boundaries between various components, operations and data stores are somewhat arbitrary, and particular operations are illustrated in the context of specific illustrative configurations. Other allocations of functionality are envisioned and may fall within the scope of the disclosure. In general, structures and functionality presented as separate components in the example configurations may be implemented as a combined structure or component. Similarly, structures and functionality presented as a single component may be implemented as separate components. These and other variations, modifications, additions, and improvements may fall within the scope of the disclosure.

The flowcharts are provided to aid in understanding the illustrations and are not to be used to limit scope of the claims. The flowcharts depict example operations that can vary within the scope of the claims. Additional operations may be performed; fewer operations may be performed; the operations may be performed in parallel; and the operations may be performed in a different order. It will be understood that each block of the flowchart illustrations and/or block diagrams, and combinations of blocks in the flowchart illustrations and/or block diagrams, can be implemented by program code. The program code may be provided to a processor of a general-purpose computer, special purpose computer, or other programmable machine or apparatus.

Use of the phrase "at least one of" preceding a list with the conjunction "and" should not be treated as an exclusive list and should not be construed as a list of categories with one item from each category, unless specifically stated otherwise. A clause that recites "at least one of A, B, and C" can be infringed with only one of the listed items, multiple of the listed items, and one or more of the items in the list and another item not listed.

As used herein, the term "or" is inclusive unless otherwise explicitly noted. Thus, the phrase "at least one of A, B, or C" is satisfied by any element from the set {A, B, C} or any combination thereof, including multiples of any element.

EXAMPLE EMBODIMENTS

Embodiment #1: A seal element for providing a seal in a wellbore, the seal element comprising: a bonded seal with profiled surface that extends beyond a surface of a sleeve that includes the bonded seal with the profile surface, wherein the profiled surface of the bonded seal is to face a surface of a housing to form the seal, wherein the bonded seal with profiled surface has an asymmetric shape that comprises a back angle that is an acute angle.

Embodiment #2: The seal element of Embodiment #1, wherein the asymmetric shape comprises a front angle that is different than the back angle.

Embodiment #3: The seal element of Embodiment #2, wherein the front angle comprises a first angle at zero degrees and a second angle that is an acute angle.

Embodiment #4: The seal element of Embodiment #3, wherein the second angle is approximately 45 degrees.

Embodiment #5: The seal element of one or more of Embodiment #1-4, wherein the bonded seal with profiled surface is formed within a gland of the sleeve.

Embodiment #6: The seal element of Embodiment #5, wherein the back angle is to extend to a bottom surface of the gland.

Embodiment #7: The seal element of Embodiment #6, wherein a void is formed within the gland between a side surface of the bonded seal with profiled surface having the back angle and a side surface of the gland.

Embodiment #8: The seal element of Embodiment #7, wherein a void index of the void comprises a void volume of the void divided by a gland volume of the gland.

Embodiment #9: The seal element of Embodiment #8, wherein the void index is a nonlinear function of a seal back angle and a width of a seal surface of the bonded seal.

Embodiment #10: The seal element of Embodiment #8, wherein the void index of the void is between approximately 0.25 and 0.45.

Embodiment #11: The seal element of one or more of Embodiments #7-10, wherein the void is filled with a seal backup material.

Embodiment #12: A method for forming a seal element in a sleeve to provide a seal for operation in a wellbore, the method comprising: molding a seal into a seal gland of the sleeve, wherein the seal is to extend beyond a side of the sleeve where the seal gland is located; and machining a surface of the seal to profile the seal with an asymmetric shape that comprises a back angle that is an acute angle.

Embodiment #13: The method of Embodiment #12, wherein a front angle is different than the back angle.

Embodiment #14: The method of Embodiment #13, wherein the front angle comprises a first angle at zero degrees and a second angle at an acute angle.

Embodiment #15: The method of one or more of Embodiments #12-14, wherein the back angle is to extend to a bottom surface of the gland.

Embodiment #16: The method of Embodiment #15, wherein a void is formed within the seal gland between a side surface of the seal having the back angle and a side surface of the seal gland, wherein a void index of the void comprises a void volume of the void divided by a gland volume of the seal gland, and wherein the void index is between approximately 0.25 and 0.45.

Embodiment #17: A downhole tool to be positioned in a wellbore, the downhole tool comprising: a sleeve to cyclically support a load, the sleeve comprising, at least one seal element to provide a seal, wherein the at least one seal element comprises, a bonded seal with profiled surface that extends beyond a surface of the sleeve that includes the bonded seal with the profile surface, wherein the profiled surface of the bonded seal is to face a surface of a housing to form the seal, wherein the bonded seal with profiled surface has an asymmetric shape that comprises a back angle that is an acute angle.

Embodiment #18: The downhole tool of Embodiment #17, wherein the asymmetric shape comprises a front angle that is different than the back angle.

Embodiment #19: The downhole tool of Embodiment #18, wherein the front angle comprises a first angle at zero degrees and a second angle at 45 degrees, and wherein the back angle is between 8 and 28 degrees.

Embodiment #20: The downhole tool of one or more of Embodiments #17-19, wherein the bonded seal with profiled surface is formed within a gland of the sleeve, wherein the back angle is to extend to a bottom surface of the gland, wherein a void is formed within the gland between a side surface of the bonded seal with profiled surface having the back angle and a side surface of the gland, wherein a void index of the void comprises a void volume of the void divided by a gland volume of the gland, wherein the void index is a nonlinear function of a seal back angle and a width of a seal surface of the bonded seal with profiled surface, and wherein the void index is between 0.25 and 0.45.

The invention claimed is:

1. A seal element for providing a seal in a wellbore, the seal element comprising:

a bonded seal to be formed within a gland of a sleeve, the bonded seal with a profiled surface that extends beyond a surface of the sleeve, wherein the profiled surface of the bonded seal is to face a surface of a housing to form a seal, wherein the bonded seal with the profiled surface has an asymmetric shape that comprises a back angle that is an acute angle defined by the profiled surface that extends in a straight line to reach a bottom surface of the gland to form a void within the gland, wherein a volume of the void divided by a volume of the gland defines a void index between 0.25 and 0.45, the void index having a variance of +/−10%.

2. The seal element of claim 1, wherein the asymmetric shape comprises a front angle that is different than the back angle.

3. The seal element of claim 2, wherein the front angle comprises a first angle at zero degrees and a second angle that is an acute angle.

4. The seal element of claim 3, wherein the second angle is 45 degrees, with a variance of +/−10%.

5. The seal element of claim 1, wherein the bonded seal comprises rubber.

6. The seal element of claim 1, wherein the back angle is between 8 and 28 degrees, with a variance of +/−10%.

7. The seal element of claim 6, wherein the void index is between 0.30 and 0.35, with a variance of +/−10%.

8. The seal element of claim 1, wherein the void is formed within the gland between a side surface of the bonded seal with the profiled surface having the back angle, and a side surface of the gland that is disposed substantially perpendicular to the bottom surface of the gland.

9. The seal element of claim 8, wherein the void index is between 0.30 and 0.35, with a variance of +/−10%.

10. The seal element of claim 8, wherein the void is filled with a seal backup material.

11. The seal element of claim 1, wherein the void index is between 0.30 and 0.35, with a variance of +/−10%.

12. A method for forming a seal element in a sleeve for operation in a wellbore, the method comprising:

molding rubber into a seal gland of the sleeve, wherein the rubber is to extend beyond a side of the sleeve where the seal gland is located; and machining a surface of the rubber to profile the seal element with a profiled surface having an asymmetric shape that comprises a back angle that is an acute angle defined by the profiled surface that extends in a straight line to reach a bottom surface of the gland to form a void within the gland, wherein a volume of the void divided by a volume of the gland defines a void index between 0.25 and 0.45, the void index having a variance of +/−10%.

13. The method of claim 12, wherein a front angle of the profiled surface is different than the back angle.

14. The method of claim 13, wherein the front angle comprises a first angle at zero degrees and a second angle at an acute angle.

15. The method of claim 12, wherein the back angle is between 8 and 28 degrees, with a variance of +/−10%.

16. The method of claim 15, wherein the void index is between 0.30 and 0.35, with a variance of +/−10%.

17. A downhole tool to be positioned in a wellbore, the downhole tool comprising:

a sleeve to cyclically support a load, the sleeve comprising, at least one seal element to provide a seal, wherein the at least one seal element comprises, a bonded seal with a profiled surface that extends beyond a surface of the sleeve that includes the bonded seal with the profile surface formed in a gland of the sleeve, wherein the profiled surface of the bonded seal is to face a surface of a housing to form the seal, wherein the bonded seal with the profiled surface has an asymmetric shape that comprises a back angle that is an acute angle defined by the profiled surface that extends in a straight line to reach a bottom surface of the gland to form a void within the gland, wherein a volume of the void divided by the volume of the gland defines a void index between 0.25 and 0.45, the void index having a variance of +/−10%.

18. The downhole tool of claim 17, wherein the asymmetric shape comprises a front angle that is different than the back angle.

19. The downhole tool of claim 18, wherein the front angle comprises a first angle at zero degrees and a second angle at 45 degrees, with a variance of +/−10%, and wherein the back angle is between 8 and 28 degrees, with a variance of +/−10%.

20. The downhole tool of claim 17, wherein the void index is between 0.30 and 0.35 with a variance of +/−10%.

* * * * *